US005228699A

United States Patent [19]

Ludwick et al.

[11] Patent Number: 5,228,699

[45] Date of Patent: Jul. 20, 1993

[54] BOARD GAME

[75] Inventors: John H. Ludwick, Bellevue; Donald P. Jarvis, Seattle, both of Wash.

[73] Assignee: Jarwick Enterprises Ltd., Seattle, Wash.

[21] Appl. No.: 510,049

[22] Filed: Apr. 17, 1990

Related U.S. Application Data

[62] Division of Ser. No. 285,082, Dec. 16, 1988, Pat. No. 4,938,482.

[51] Int. Cl.[5] ..... A63F 3/02

[52] U.S. Cl. ..... 273/260

[58] Field of Search ..... 273/242, 243, 260, 282, 273/286, 285, DIG. 4, DIG. 5, DIG. 6, DIG. 11

[56] References Cited

U.S. PATENT DOCUMENTS

| | | | |
|---|---|---|---|
| 191,169 | 5/1877 | Nutting | 273/242 |
| 574,192 | 12/1896 | Climenson | 273/260 |
| 613,550 | 11/1898 | Ballou | 273/260 |
| 1,474,504 | 11/1923 | Allen | 273/260 |
| 2,586,039 | 2/1952 | Heggedal | 273/286 X |
| 3,811,682 | 5/1974 | Neale et al. | 273/DIG. 5 |
| 3,836,151 | 9/1974 | Bowerman | 273/286 X |
| 3,880,429 | 4/1975 | Blumenaus | 273/282 A |
| 3,952,133 | 4/1976 | Amos et al. | 428/334 |
| 3,984,110 | 10/1976 | Eckert | 273/286 |

FOREIGN PATENT DOCUMENTS

| | | | |
|---|---|---|---|
| 43971 | 4/1981 | Japan | 273/DIG. 11 |

OTHER PUBLICATIONS

Gift and Decorative Accessories (GDA), Jul. 1973, p. 109 (class 273, subclass 286).

"Alkathene", Technical Data Sheet, A. TD401, 2 pages, May 1969 (class 273, subclass DIG. 11).

*Primary Examiner*—Edward M. Coven
*Assistant Examiner*—William E. Stoll
*Attorney, Agent, or Firm*—Seed and Berry

[57] ABSTRACT

There is provided a game board for playing a board game, and methods for playing the same. The board is divided into eight rows and eight columns which define sixty-four squares. These squares alternate in color to define thirty-two playing spaces. These spaces are assigned a value such that the sum of the valued spaces contained in the middle four rows of the board is greater than the sum of the valued spaces contained in the first two and last two rows of the board. Points are awarded during play for movement of playing pieces upon the valued spaces of the board, and for jumping the opponent's playing pieces. Points are tallied for each player to determine a winner.

11 Claims, 2 Drawing Sheets

BOARD GAME

This application is a divisional of U.S. patent application Ser. No. 07/285,082, filed Dec. 16, 1988, now U.S. Pat. No. 4,938,482.

FIELD OF THE INVENTION

The present invention relates to a board game and, more particularly, to a game board and methods of playing the same.

BACKGROUND OF THE INVENTION

Board games and their many variants have existed since ancient times. One particular board game which has obtained considerable recognition and play is the game of Checkers or Draughts. The game of Checkers is played on a large grid, or checkerboard, of eight rows and eight columns that define sixty-four squares, each adjacent square alternating in color. All play is conducted upon a single color of the checkerboard, and each player begins play with twelve game pieces of his own color. The players sit on opposite sides of the checkerboard and one of the players moves first. Thereafter, the players make alternating moves.

When it is time to make a move, the player may move one of his game pieces one space in a diagonally forward direction provided that space is vacant. Alternatively, the player may capture an opposing player's game piece occupying a diagonally forward space if the next diagonal space beyond the piece to be captured is vacant. To do so, the player jumps over the piece to be captured to the vacant square, and then removes from the checkerboard the piece jumped.

If a jumping piece lands in a square from which a further jump can take place, the piece must continue jumping in the same turn to capture the additional piece. Thus, if a player is able to capture an opponent's piece he must do so and forgo making a non-capturing move. If, however, several jumps are possible, the player may chose which piece to capture.

At the start of the game, all of the pieces on the board are single pieces, and such a piece can only move in a diagonally forward direction. The row of spaces nearest each player is called the King's row. When an opponent's piece lands in a space along this row, the piece is crowned (i.e., an additional piece is stacked upon the single piece) and thus becomes a King. A King has the same ability to move and capture as a single piece, and, in addition, may move and capture in a diagonally backwards direction as well. If a single piece reaches the King's row by jumping an opponent's piece, the jumping piece is crowned, but cannot continue jumping in that same turn.

The object of the game of Checkers is to reach a point in the game where your opponent is unable to move any of his pieces. While this is often accomplished by capturing all twelve of the opponent's pieces, it may also be done by blocking the further movement of all pieces. Thus, the first player unable to move a piece loses the game.

When two players have had sufficient experience playing the game of Checkers, the game may become a very time-consuming process to play. In addition, the game becomes a defensive struggle in that a player may be unwilling to move pieces off his King's row. Often, after a great deal of time, neither player is capable of winning the game, and the game ends in a draw.

Variations on the game of checkers have been tried using numbered spaces to penalize or reward a player who lands on one of those spaces. Games shown in U.S. Pat. Nos. 1,474,504 and 191,169 show two such games. These games as in regular checkers however have the disadvantage of encouraging defensive play by maintaining defensive tile in the spaces closest to each player's King's row. This tends to slow the game and make less interesting.

DISCLOSURE OF THE INVENTION

Accordingly, it is an object of this invention to provide a board game which can be played and completed in an amount of time chosen by the players prior to playing the game.

It is another object of this invention to provide a board game which is challenging and exciting to play.

It is still another object of this invention to provide a board game which incorporates certain concepts from widely-known prior art board games in the nature of Checkers to thus render the playing of the board game readily learnable without requirement of extensive study.

A further object of this invention is to provide a board game upon which a player's accumulated score can be tallied.

Still another object of this invention is to provide an improved board game material which is easy to store and use.

Briefly stated, the present invention discloses a game board for playing a board game comprising a grid having eight rows and eight columns defining sixty-four squares, the squares alternating in color to identify a field of play containing thirty-two spaces. One space within each row, called a check, is assigned a negative integer value, and the remaining three spaces within each row, called dice, are assigned a positive integer values. The values are assigned such that the numerical sum of the checks and dice contained in the middle four rows are greater than the numerical sum of the checks and dice in the remaining four rows. In addition, the pattern of checks and dice in the four rows immediately in front of each player is identical.

The invention strives to make the game become an offensive race to achieve the greatest amount of points. As stated above, the invention locates the highest values on the spaces in the middle four rows of the board. This requires the players to move their pieces toward the center of the board to accumulate points. Thus, the game becomes an exciting, aggressive, and offensive battle played in the center of the board, rather than a defensive battle played at the King's rows.

The present invention also discloses a board game upon which each players' accumulated score may be tallied.

It also discloses a flexible board for a board game. Advantageously, the board can be stored in a roll but will lay flat upon being placed into use.

BEST MODE FOR CARRYING OUT THE INVENTION

The game board of the present invention comprises a grid having eight rows and eight columns defining sixty-four squares, the squares alternating in color to identify a field of play containing thirty-two spaces.

Figure 1:
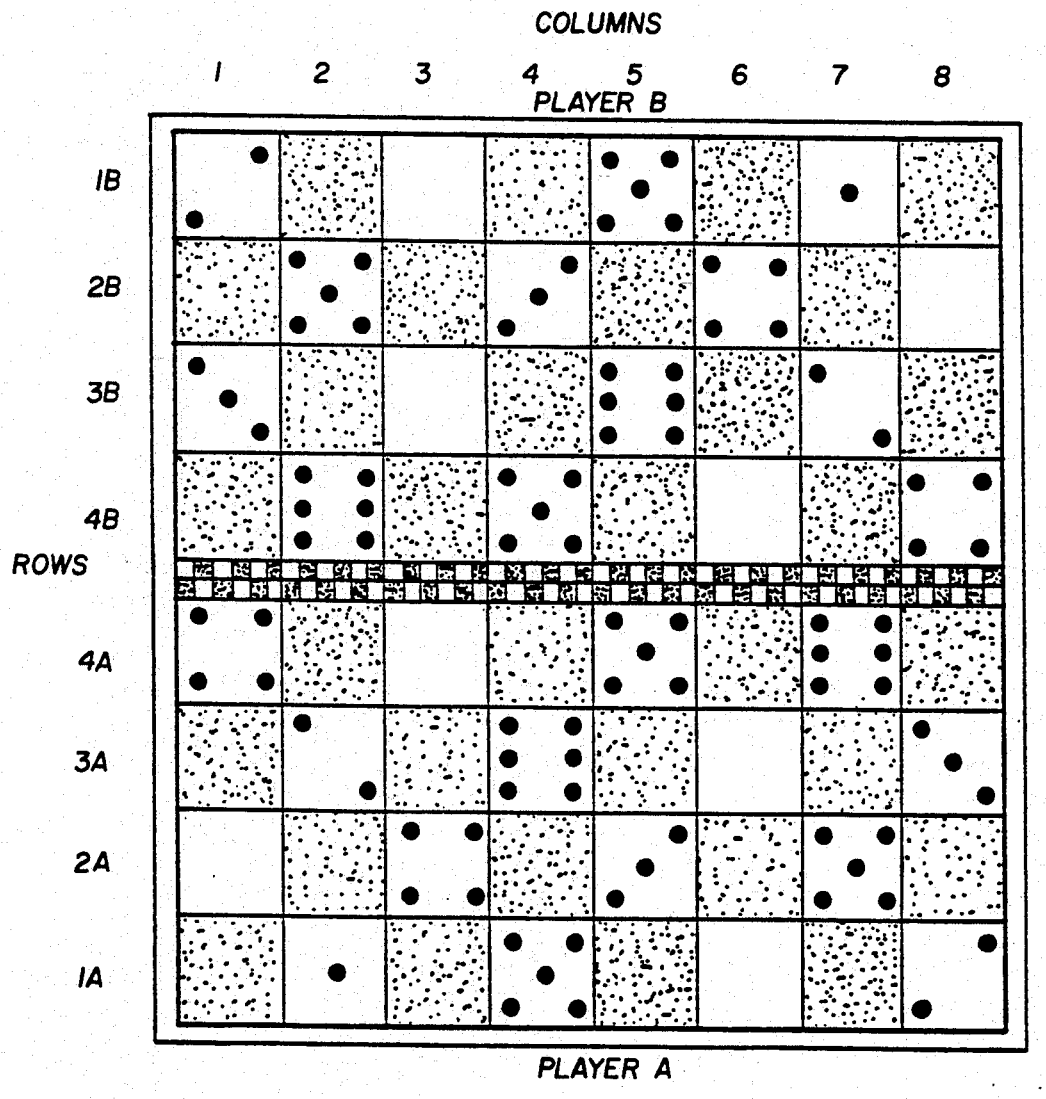
FIG. 1 is a top plan view of a game board embodied by the present invention.

Referring to FIG. 1, a preferred embodiment of the board game is depicted. The black squares of the board shown are not within the field of play. To provide a frame of reference only, the columns and rows of the grid have been numbered. Thus, the King's row for player A and player B is numbered as row 1A and 1B respectively. To refer to a particular space on the board, it may be identified by giving its row number and column number. Thus, the value of the space at column 3A and row 4 (hereinafter "(3A,4)") in this embodiment is six. While the value of six at space (3A,4) is depicted by six dots, any method of identifying the value at this space may be used. To provide for fair and even play, the first four rows of the grid are reverse mirror images of the last four rows of the grid in that the value assigned to each space within rows 1A through 4A, from player A's perspective, are identical with the value assigned to the spaces of rows 1B through 4B, from player B's perspective. Thus, each player from his own perspective will have the same pattern of valued spaces in his first four rows.

While the board game depicted in FIG. 1 contains a valued space at (1A,8) and at (1B,1), the checkerboard could be arranged in such a manner that the valued space was located instead at (1A,1) and at (1B,8). In other words, the checkerboard may be arranged such that each player has a double corner near his right hand, rather than near his left hand, as depicted in FIG. 1.

One space within each row, called a check, is assigned a value of w, wherein w is a negative integer. Referring to FIG. 1, the check of each row is represented by a blank white space. The remaining three spaces, called dice, are assigned a value of x, y and z respectively, wherein x, y and z are positive integers. In row 3A, for example, the check is located at (3A,6), and the remaining three dice are located at (3A,2), (3A,4) and (3A,8).

Game markers for the present invention are referred to as tiles. Twelve visually identifiable tiles are provided to each player. For example, game tiles of two different colors may be used. At the beginning of play, the tiles of each player are placed upon the spaces contained in rows 1A–3A and 1B–3B, with rows 4A and 4B containing no tiles.

The board game of the present invention is a game of points. Any single tile may move and jump forward in a diagonal direction only on the checks or dice. A pair (i.e., a stack of two tiles) is allowed to move and jump forward and backward diagonally. Points are accumulated as a player lands on the dice. When a player lands on a specific dice the value of that dice is added to a player's score. If a player's piece lands on a check, that value is deducted from the player's score. The deducted value is doubled if a pair of tiles lands on a check. If a tile is jumped during play, that tile is then removed from the board.

A value is awarded for each tile jumped by a single tile. Double that value is awarded if a pair jumps a single tile. Preferably, five points are awarded for each tile jumped by a single piece, and ten points awarded for each tile jumped by a pair. Similarly, a value is awarded if a single tile jumps a pair, and a greater value is awarded if a pair jumps a pair. Preferably, ten points are awarded if a single tile jumps a pair, and twenty-five points awarded if a pair jumps a pair. When a tile reaches the opponent's King's row, bonus points are awarded for landing on the King's row and an additional tile is added to make a pair and complete that move. Preferably, five bonus points are awarded when a tile reaches the opponent's King's row.

As a further restriction, a pair can only repeat the same move three times. It must also be kept in mind that at no time during a jump sequence are the points under the jumped tile added to the player's score.

The first player to reach a specific score wins the game. For example, before the game starts each player may agree that the game will end and be won by the first player reaching 100. Alternatively, the players may agree upon any value they wish depending upon the time they have available to play the game.

If the players wish to play a longer game, they may choose a larger winning score, for example, 500.

In addition, when a player reaches the score of 100, he is entitled to redeem one tile and put it back into the field of play. The players may then continue to redeem a tile at increments of one hundred. When redeeming a tile, the tile is placed on a check or dice within the player's King's row. That player must, however, wait until his next move in sequence after he reaches 100 points to return or redeem a tile back into action. A player does not have to enter a redeemed tile immediately, but that player loses the right to redeem the tile if he has not done so within three moves after the 100 point increment is reached. Bringing the tile back into play counts as a move and the value of the check or dice that the redeemed tile is placed upon is subtracted from or added to the player's score.

The players may continue to move and score until all tiles of one player are gone. When this occurs, the player with the highest score wins the game. Thus, a player with no remaining tiles may still be the winner of the game.

A number of variations of play are possible. For example, the players may initiate play by placing all twenty-four tiles on only the dice, leaving the checks open. Alternatively, the players may place nine tiles on the dice of the first three rows, leaving the checks open. The game may also be played by alternately placing tiles on the field of play. Thus, each player alternately places one tile on any dice until all six tiles are placed. The player placing the initial tile also makes the first move after all tiles are placed. Players may also move the tiles backward or forward. Each backward move automatically discounts the player's score by five points, but the player may add the points from the dice on which he lands to his score. Once a tile is paired, the backward penalty may be removed.

Since all versions of the board game of the present invention are games of points, it is possible that a player may lose all his tiles and yet still win the game.

To provide for aggressive movement of pieces and exciting play, it is necessary that the sum of all spaces within rows 3A, 4A, 3B and 4B (i.e., w, x, y and z) be greater than the sum of all spaces within rows 1A, 2A, 1B and 2B (i.e., w', x', y' and z'). Referring again to FIG. 1, the w, x, y and z value of all spaces within rows 3A, 4A, 3B and 4B is thirty-two. Similarly, the w', x', y' and z' values of all spaces within rows 1A, 2A, 1B and 2B is twenty. Preferably, the sum of the check and dice of the middle four rows is at least five greater than the sum of all checks and dice of the remaining four rows. More preferably, the sum is ten greater. The greater value contained in the middle four rows promotes movement towards the center of the board by enticing a player to obtain a greater value for a move. Thus, the game becomes an offensive race to achieve the greatest amount of points in the least amount of time, rather than a defensive battle.

Preferably, the value of w is negative five, and the values of x, y and z are a positive integer ranging from one to six.

A preferred embodiment of the game board of the present invention has the spaces valued as follows: The value of six is assigned to the dice located at (3A,4), (4A,7), (4B,2) and (3B,5); the value of five is assigned to the dice located at (1A,4) (2A,7), (4A,5), (4B,5), (2B,2) and (1B,5); the value of four is assigned to the dice located at (2A,3), (4A,1), (4B,8) and (2B,6); the value of three is assigned to the dice located at (2A,5), (3A,8), (3B,1) and (2B,4); the value of two is assigned to the dice located at (1A,8), (3A,2), (3B,7) and (1B,1); the value of one is assigned to the dice located at (1A,2) and (1B,7); and the value of negative five is assigned to the checks located at (1A,6), (2A,1), (3A,6), (4A,3), (4B,6), (3B,3), (2B,8) and (1B,3).

Figure 2:
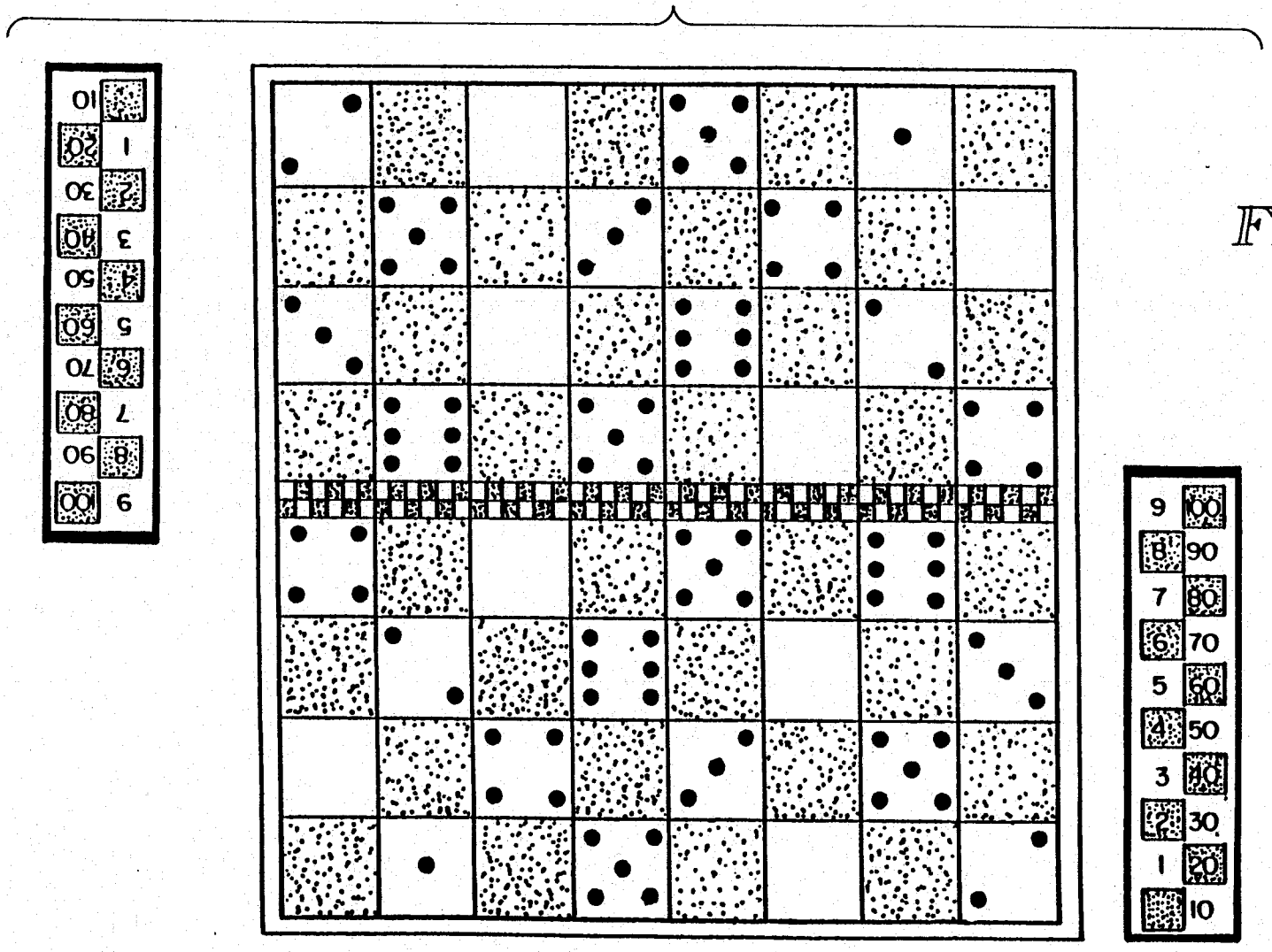
FIG. 2 is a top plan view of a game board embodied by the present invention upon which the players' scores may be tallied.

Referring to FIG. 2, a board game is depicted wherein a method of tallying the score is located on the board game. Two smaller scoring markers, called chips, maintain each player's accumulated points during play by placing a chip on the appropriate numbers. Thus, the score forty-three would be represented by one chip placed upon the number "40" and the second chip placed upon the number "3."

The board game of the present invention is preferably on a rubber-like material for the board. For example, a close-cell ethyl vinyl acetate material with a nylon fabric laminate surface provides a desirable board. Such a board preferably will not wrinkle and will lay flat. The board has "no memory," that is, it will return to a flat shape when layed flat even though it is conveniently stored in a roll. In addition, the board must be printable, and it is preferably that it be nonskid. Such a close-cell material with a nylon surface is sold under the name of "Rubatex."

While particular embodiments of this invention have been shown and described, this invention is not limited to them unless limitation is necessary due to the prior art or spirit of the appended claims. Modifications which fall within the true spirit and the principles disclosed in this description are meant to be included to the extent possible.

I claim:

1. A method of playing a board game comprising:

selecting a point value at which play will stop;

receiving points for movement of a game piece upon a board, the board comprising a grid having eight rows and eight columns defining 64 squares, the squares alternating in color to identify a field of play containing 32 spaces, one space within each row of the grid being assigned the value of w, wherein w is a negative integer, and the remaining three spaces within each row being assigned a value of x, y and z, respectively, wherein x, y and z are positive integers, the sum of w, x, y, and z of the middle four rows of the grid being greater than the sum of w, x, y, and z of the first two and the last two rows of the grid to promote aggressive movement toward the center of the board, and the first four rows of the grid being a reverse mirror image of the last four rows of the grid, the points received for movement of the game piece upon the board being determined by the positive or negative integer value assigned the space upon which the game piece lands;

receiving points for jumping an opponent's game piece, the points received for jumping the opponent's game piece being a positive integer, with the proviso that the positive or negative integer value of the space containing the opponent's game piece being jumped is neither received as points for the jump nor is that value deducted from the opponent's score, and with the further proviso that the game pieces are not assigned individual values; and tallying the points received during play for movement of the game pieces upon the board and for jumping an opponent's game piece to determine a winner, the winner being the first to achieve the selected point value.

2. The method of claim 1 wherein w is negative 5.

3. The method of claim 1 wherein x, y and z are positive integers ranging from 1 to 6.

4. The method of claim 1 wherein the sum of w, x, y and z of the middle four rows is at least 5 greater than the sum of w, x, y and z of the first two and last two rows.

5. The method of claim 1 wherein the sum of w, x, y and z of the middle four rows is at least 10 greater than the sum of w, x, y and z of the first two and last two rows.

6. The method of claim 1 wherein the points received for jumping an opponent's game piece is greater when a pair jumps an opponent's single game piece or when a single game piece jumps an opponent's pair, and is greatest when a pair jumps an opponent's pair.

7. The method of claim 1 wherein the points received for jumping an opponent's game piece is 5 when a single game piece jumps an opponent's single game piece, is 10 when a pair jumps an opponent's single game piece, is 10 when a single game piece jumps an opponent's pair, and is 25 when a pair jumps an opponent's pair.

8. The method of claim 1 wherein the negative integer value of the space is doubled when the game piece is a pair and lands upon the space.

9. The method of claim 1 further including the following steps:

receiving points for moving the game piece to the opponent's king's row.

10. The method of claim 8 wherein the value of the points received for moving the game piece to the opponent's king's row is 5.

11. The method of claim 1 wherein a lost game piece is redeemed at 100 point intervals.

* * * * *

UNITED STATES PATENT AND TRADEMARK OFFICE

CERTIFICATE OF CORRECTION

PATENT NO. : 5,228,699

DATED : July 20, 1993

INVENTOR(S) : John H. Ludwick and Donald P. Jarvis

It is certified that error appears in the above-identified patent and that said Letters Patent is hereby corrected as shown below:

In column 6, claim 9, line 54, please delete "steps" and substitute therefor --step--.

Signed and Sealed this

Fifteenth Day of March, 1994

Bruce Lehman

*Attest:*

BRUCE LEHMAN

*Attesting Officer*

*Commissioner of Patents and Trademarks*